United States Patent [19]

Stevens et al.

[11] Patent Number: 5,061,831

[45] Date of Patent: Oct. 29, 1991

[54] HERMETIC SWITCH

[75] Inventors: Phillip D. Stevens, Gilbert; Arthur W. Mittendorf, Litchfield Park, both of Ariz.

[73] Assignee: Motorola, Inc., Schaumburg, Ill.

[21] Appl. No.: 548,467

[22] Filed: Jul. 3, 1990

[51] Int. Cl.[5] ..... H01H 9/04

[52] U.S. Cl. ..... 200/302.001; 200/336; 200/570; 200/11 A; 200/11 E

[58] Field of Search ..... 200/302.1, 302.2, 302.3, 200/336, 331, 330, 564, 570, 571, 11 A, 11 G, 11 EA, 11 E, 11 J

[56] References Cited

U.S. PATENT DOCUMENTS

| | | | |
|---|---|---|---|
| 3,115,555 | 12/1963 | Lescarboura | 200/302.3 |
| 4,074,097 | 2/1978 | Hutchinson et al. | 200/302.1 |
| 4,476,360 | 10/1984 | Theurer | 200/302.1 |
| 4,937,407 | 6/1990 | Osika | 200/302.3 |

FOREIGN PATENT DOCUMENTS

| | | | |
|---|---|---|---|
| 1208382 | 1/1965 | Fed. Rep. of Germany | 200/302.1 |
| 1805965 | 6/1970 | Fed. Rep. of Germany | 200/302.3 |
| 2344856 | 6/1975 | Fed. Rep. of Germany | 200/302.2 |
| 1410425 | 8/1965 | France | 200/302.2 |

*Primary Examiner*—Ernest G. Cusick

*Attorney, Agent, or Firm*—Robert M. Handy; Jordan C. Powell

[57] ABSTRACT

A hermetically sealed switch with multiple switching positions comprises an actuator welded or soldered to a metallic diaphragm. The diaphragm is in turn welded or soldered to the inner walls of the switch housing. The diaphragm is flexible and allows the actuator to pivot about the welded portion. The pivoting motion causes rotation at each end of the actuator. Therefore, if one end of the actuator is rotated, the other end will similarly rotate about while the weld between the actuator and the diaphragm remains intact. The sealed end of the actuator is inserted into a rotor. The rotor has a metal piece which rotates in a circular manner and couples individual contacts to a common electrical ground. Each contact represents a different switch setting. As the metal piece of the rotor couples the contact with the ground, current is allowed to flow between the two and the setting represented by the contact is selected. Electrical leads couple the contacts and the ground to the sealed host device.

18 Claims, 1 Drawing Sheet

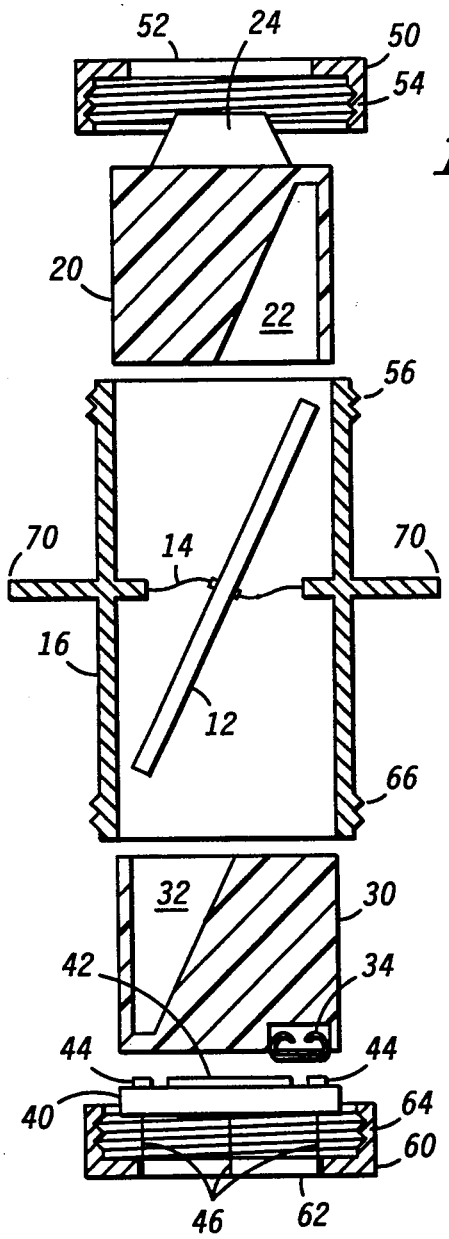
FIG. 1
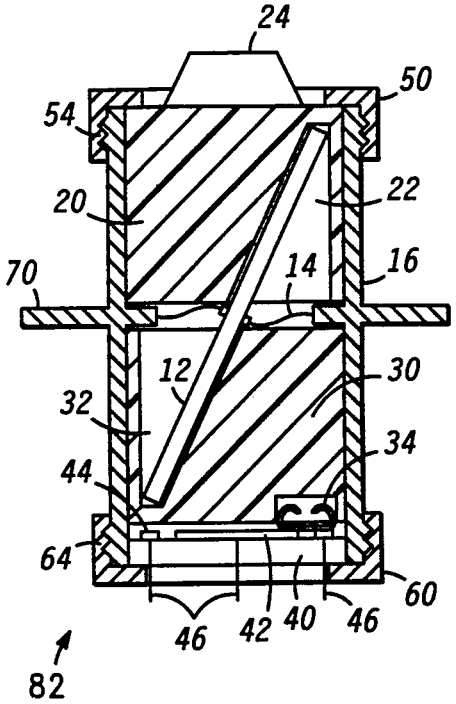
FIG. 3
FIG. 4
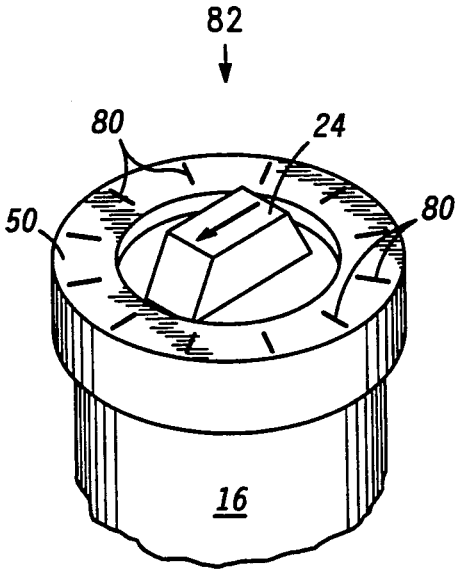
FIG. 2
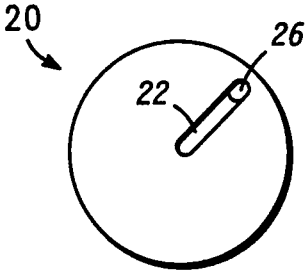

HERMETIC SWITCH

BACKGROUND OF THE INVENTION

This invention relates, in general, to mechanical switches, and more specifically, to stand-alone hermetically sealed switches.

Most mechanical multi-position switches requiring protection from the environment are constructed using "O" rings made of rubber or some sort of synthetic material similar to rubber. The "O" ring is secured about a shaft or other type of actuator extending into a contact chamber. The chamber is generally completely sealed except where the shaft passes through the "O" ring. The "O" ring is secured tightly about the shaft and does not allow the elements into the chamber. However, over long periods of time, the "O" ring cannot keep water vapor out of the chamber. Water vapor permeates the "O" ring and eventually corrodes the contacts within the chamber. Therefore, switches utilizing "O" rings can only be protected from the open air and environmental conditions for short periods of time without additional protective housing.

There are many applications which require mechanical switches to remain operational over long periods of time. One such application is in the military arena. Munitions, such as free-fall bombs, often require mechanical switches. These munitions are stored for many years at a time before ever being used. The mechanical switches associated with these munitions must be stored in separate hermetically sealed containers to ensure the contacts of the switches are not corroded prior to use. When the munition is to be used, an operator must remove the switch from the container and connect the switch to the munition. Obviously, a hermetically sealed switch which can be stored attached to the munition, therefore eliminating costly packaging, is preferred.

Conventional hermetically sealed switches are push button type switches, and therefore, only one contact or setting can be activated with a single switch. As additional settings are needed, additional push button switches are added. A switch requiring up to 10 settings could be as large as four to five inches across. These types of switches are not practical with munitions or other applications where the associated host device is small.

SUMMARY OF THE INVENTION

Accordingly, it is an object of the present invention to provide a hermetically sealed multi-position switch which is small and compact.

A hermetically sealed switch with multiple switching positions comprises an actuator welded or soldered to a metallic diaphragm. The diaphragm is in turn welded or soldered to the inner walls of the switch housing. The diaphragm is flexible and allows the actuator to pivot about the welded portion. The pivoting motion causes rotation at each end of the actuator. Therefore, if one end of the actuator is rotated, the other end will similarly rotate about while the weld between the actuator and the diaphragm remains intact. The sealed end of the actuator is inserted into a rotor. The rotor has a metal piece which rotates in a circular manner and couples individual contacts to a common electrical ground. Each contact represents a different switch setting. As the metal piece of the rotor couples the contact with the ground, current is allowed to flow between the two and the setting represented by the contact is selected. Electric leads couple the contacts and the ground to the sealed host device.

The above and other objects, features, and advantages of the present invention will be better understood from the following detailed description taken in conjunction with the accompanying drawings.

BRIEF DESCRIPTION OF THE DRAWING

FIG. 1 is a cut-away side view of the switch in its unassembled condition according to the present invention.

FIG. 2 is a top view of an element of the switch of FIG. 2.

FIG. 3 is the cut-away side view of FIG. 2 with the switch assembled according to the present invention.

FIG. 4 is an isometric view of the switch as mounted according to the present invention.

DETAILED DESCRIPTION OF THE INVENTION

Those familiar with prevention of corrosion by electronic devices will recognize that unless the housing of the electronic device is air-tight, water and possibly chemicals will seep into the container and react with the device's metal. Furthermore, seals incorporating rubber and other synthetic materials will, over a short time period, prevent substantial corrosion. However, these materials are not impermeable and will eventually allow water vapor and chemical vapor to permeate into the housing. For instance, "O" rings are commonly employed to seal an aperture where one element is inserted into an otherwise sealed container. The "O" ring will effectively prevent corrosion over a short time period. However, since "O" rings are permeable, sufficient water vapor will eventually enter the container and corrode the inner protected contacts. Hermetical seals are required to completely seal a container from the outside environment over long periods of time.

FIG. 1 shows a cut-away side view of a hermetically sealed multiposition switch 10 in its preferred embodiment. Switch 10 is shown in FIG. 1 in a dismembered condition to distinctly show each of its members.

Switch 10 comprises actuator 12, diaphragm 14, housing 16, top rotor 20, bottom rotor 30, contact plate 40, and top and bottom supports 50 and 60.

Hermetic seals utilize either metal-to-metal contact or glass-to-metal contact. Switch 10, according to the preferred embodiment, utilizes a metal-to-metal contact to hermetically seal bottom rotor 30 and contact plate 40 from any water vapor or other elements entering through the top of switch 10. Specifically, actuator 12 (actuator 12 in its preferred embodiment is a metal) is welded to diaphragm 14 preferably about the center portion of actuator 12. Diaphragm 14 is in turn welded to housing 16, preferably at the center of the cavity defined by housing 16. Diaphragm 14 is flexible and operates in a bellows fashion. Diaphragm 14 allows actuator 12 to pivot about its welded position in a stirring motion. Thus, each end of actuator 12 may rotate about in a circular manner.

With continued, extended motion of actuator 12, diaphragm 14 will eventually fatigue. The operational life of diaphragm 14 is dependent upon its design. Diaphragm 14 will be designed substantially different if switch 10 is to monitor or produce extended rotations than if switch 10 is designed to monitor or produce very few rotations by actuator 12. The specific design of diaphragm 14 is not the object of this invention. One having ordinary skill in the art of materials and fatigue can easily design diaphragm 14 to meet various requirements.

Actuator 12 is inserted into grooves within top and bottom rotors 20 and 30. FIG. 2 shows a bottom view of top rotor 20 to illustrate how actuator 12 contacts with top rotor. A groove 22 in the bottom of top rotor 22 guides actuator 12 to a securing hole 26. Hole 26 is just large enough to allow the end of actuator 12 to securely rest in hole 26 without slipping after switch 10 is assembled. The shape of groove 22 operates to guide actuator 12 into hole 26 as switch 10 is being assembled. The bottom end of actuator 12 is similarly inserted into bottom rotor 30 via groove 32. Without the grooves in the rotors illustrated by grooves 22 and 32, assembly of rotors 20 and 30 with actuator 12 would be nearly impossible. In the preferred embodiment, rotors 20 and 30 are made of plastic.

Bottom rotor 30 has a metal coupler 34 inserted to the bottom portion of bottom rotor 30. Metal coupler 34 rotates in a circular fashion as actuator 12 is rotated. Bottom rotor 30 may have more than one metal coupler 34. For instance, if a switching position must activate more than one of contact points 44, more than one metal coupler 34 is required.

Contact plate 40 has a number of contact points 44, and a ground plate 42 on a face adjacent to bottom rotor 30. The number of contact points 44 depends upon the number of switching positions desired for a specific application of switch 10. Electric leads 46 extend from each of the contact points 44 and from ground plate 42. Electric leads 46 are coupled to the host electric circuitry (not shown). Metal coupler 34 of bottom rotor 30 couples one each of the contact points 44 to ground plate 42 successively as actuator 12 rotates bottom rotor 30 about in its circular path. Each of the contact points 44 represent switching positions for switch 10, and rotating bottom rotor 30 about allows switch 10 to actuate different switch points.

A knob 24 is secured to the top portion of top rotor 20. Knob 24 allows an operator to rotate actuator 12 via top rotor 20 and thus switch metal coupler 34 to different contact points 44.

Top and bottom supports 50 and 60 secure top and bottom rotors 20 and 30 and contact plate 40 within housing 16. In the preferred embodiment, top and bottom supports 50 and 60 are secured to housing 16 using threads 54 and 56, and 64 and 66, respectively. An aperture 62 in bottom support 60 allows electrical leads 46 to extend outside of switch 10. Similarly, an aperture 52 allows knob 24 to extend past top support 50.

In the preferred embodiment, the bottom portion of switch 10 is not sealed from the inner chamber of the host device. In circumstances where switch 10 must be sealed from the host device, support 60 is welded, or otherwise hermetically sealed, to housing 16. Aperture 62 is sealed using a glass-to-metal hermetic seal to allow leads 46 to extrude into the host device cavity.

Switch 10 is preferably welded to the walls of the host device to assure that the inner chamber of the host device is hermetically sealed from the outside environment. Preferably, switch 10 is sealed to the host device at points 70 of FIG. 1.

Switch 10 may be designed to ensure that when actuator 12 is rotated to a desired position, actuator 12 does not move from that position without positive action by an operator. Detenting may be incorporated as part of switch 10. One having ordinary skill in the art will recognize that detenting generally is a spring operated locking system which will hold rotors 20 and 30 and actuator 12 in place. There are many well known types of detenting which would work adequately with switch 10.

Support 20 and knob 24 may be labelled to indicate the various switching positions as shown in FIG. 4.

FIG. 3 shows switch 10 in its assembled condition. FIG. 4 shows switch 10 assembled in an isometric view of the top portion of switch 10 as it extends from its host device (not shown).

Thus there has been provided, in accordance with the present invention, a hermetically sealed switch that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A hermetically sealed switch having one or more operational settings, the switch comprising:

a switch housing defining a chamber having first and second parts;

a flexible diaphragm sealed to the chamber to hermetically isolate the first and second parts of the chamber;

an actuator hermetically sealed to the diaphragm and having a first portion extending into the first part of the chamber and a second portion extending into the second part of the chamber; and rotating electrical connection means located within the first part of the chamber and moveably coupled to the first portion of the actuator, wherein movement of the second portion of the actuator causes the first portion of the actuator to rotate the electrical connection means to the one or more operational settings of said switch.

2. A hermetically sealed switch according to claim 1 wherein said flexible diaphragm has a curved shape.

3. A hermetically sealed switch according to claim 1 wherein the first portion of the actuator comprises an elongated metal member.

4. A hermetically sealed switch according to claim 3 wherein the first and second portions of the actuator comprise elongated metal members extending, respectively, into the first and second parts of the chamber.

5. A hermetically sealed switch according to claim 4 wherein said actuator is is welded to a central portion of said diaphragm.

6. A hermetically sealed switch according to claim 1 wherein the first and second portions of the actuator extend into the first and second parts of the chamber substantially equal distances.

7. A hermetically sealed switch according to claim 1 wherein an end of the first portion of the actuator spaced from the diaphragm moves in a circular orbit about a central axis of the chamber without the actuator rotating on its own longitudinal axis.

8. A hermetically sealed switch having one or more operational settings, the switch comprising:

a flexible diaphragm;

an actuator hermetically attached to said diaphragm at a location on said diaphragm;

a switch housing, said switch housing defining a chamber having an interior wall, wherein said flexible diaphragm is hermetically attached to said interior wall to divide said chamber into at least two parts, one of said at least two parts being hermetically separated from the environment of the other of said parts;

electrical connection means coupled to said actuator means for moving said electrical connection means to each of the operational settings to be activated, wherein said electrical connection means comprises:

a rotor coupled to said actuator;

said rotor located within said part of said chamber which is hermetically sealed from the environment of said other parts;

said actuator rotating said rotor as said actuator is pivoted about the location of the attachment of said actuator and said diaphragm; and said rotor selectively activating the operational settings as said rotor rotates.

9. A hermetically sealed switch according to claim 8 wherein the operational settings are electrical contacts.

10. A hermetically sealed switch according to claim 9 wherein said rotor comprises:

a metal coupler; and said metal coupler coupling said electrical contacts to a common electrode to allow electric current to flow through said electric contacts.

11. A hermetically sealed switch comprising:

a housing having a wall;

a plurality of electrical contacts;

a common electrode secured in close proximity to said plurality of electrical contacts;

rotatable electrical connection means for coupling said plurality of electrical contacts to said common electrode, said rotatable electrical connection means electrically coupling at least one of said plurality of electrical contacts to said common electrode when in a predetermined rotational position;

actuator means for moving said rotatable electrical connection means into said predetermined rotational position; and flexible diaphragm means hermetically sealed to said actuator means and to said wall of the hermetically sealed switch to form at least two chambers within said switch, thereby sealing one of said at least two chambers from another of said at least two chambers.

12. A hermetically sealed switch according to claim 11 wherein the rotatable electrical connection means is located in a first of said at least two chambers and the actuator means extends from the first to a second of said at least two chambers.

13. A hermetically sealed switch according to claim 12, further comprising an externally extending rotation means wherein a first part of the actuator means extends into the first chamber and a second part of the actuator means extends into the second chamber, the first part moveably engaging the rotatable electrical connection means and the second part moveably engaging said externally extending rotation means for setting the switch.

14. A hermetically sealed switch according to claim 13 wherein rotation of the externally extending rotation means causes an end of the first part to follow a circular path within the first chamber, thereby rotating the electrical connection means to the predetermined rotational position.

15. A hermetically sealed switch comprising:

a plurality of electrical contacts;

a common electrode;

a support;

said plurality of electrical contacts and said common electrode secured in close proximity to each other on said support;

coupler means for coupling said plurality of electrical contacts to said common electrode, said coupler means coupling at least one of said plurality of electrical contacts to said common electrode at a given moment;

actuator means for moving said coupler means into position to couple one or more of said plurality of electrical contacts with said common electrode;

flexible diaphragm means hermetically sealed to said actuator means, said flexible diaphragm means hermetically sealed to a wall of the hermetically sealed switch to form at least two chambers within said switch;

said flexible diaphragm means hermetically sealing one of said at least two chambers from another of said at least two chambers;

wherein said coupler means comprises:

a rotor coupled to said actuator means;

said rotor located within said one chamber which is hermetically sealed;

said actuator means rotating said rotor; and said rotor selectively coupling said plurality of electrical contacts to said common electrode to allow current flow from at least one of said plurality of electrical contacts to said common electrode.

16. A hermetically sealed switch according to claim 15 wherein said actuator means comprises an elongated metal member.

17. A hermetically sealed switch according to claim 16 wherein said flexible diaphragm means is a metallic material and said elongated metal member is welded to said flexible diaphragm means.

18. A hermetically sealed switch according to claim 15 wherein said flexible diaphragm means has a curved shape.

* * * * *